33-246 SR
9/1/81 OR 4,286,388

United States Patent [19]

Ross et al.

[11] 4,286,388

[45] Sep. 1, 1981

[54] SIGHT WITH REDUCED FRICTION LINE OF SIGHT ADJUSTMENT

[75] Inventors: Cecil J. Ross; John F. Thompson, both of El Paso, Tex.

[73] Assignee: W. R. Weaver Company, El Paso, Tex.

[21] Appl. No.: 862,463

[22] Filed: Dec. 20, 1977

Related U.S. Application Data

[63] Continuation of Ser. No. 736,661, Oct. 29, 1976, abandoned.

[51] Int. Cl.[3] ..... F41G 1/38; G02B 27/32

[52] U.S. Cl. ..... 33/246; 350/10

[58] Field of Search ..... 33/245, 246, 248, 147 K, 33/147 M; 350/10; 248/314

[56] References Cited

U.S. PATENT DOCUMENTS

| | | | |
|---|---|---|---|
| 1,950,790 | 3/1934 | Fahrenwald | 33/246 |
| 2,355,384 | 8/1944 | Litschert | 33/246 |
| 2,913,826 | 11/1959 | Petty | 33/246 |
| 3,081,548 | 3/1963 | Schwartz | 33/147 K |
| 3,184,852 | 5/1965 | Hageman | 350/10 |
| 3,762,057 | 10/1973 | Kaifesh | 33/147 K |
| 3,827,154 | 8/1974 | Kaifesh | 33/147 M |

*Primary Examiner*—Richard R. Stearns
*Attorney, Agent, or Firm*—William W. Jones

[57] ABSTRACT

A line of sight adjustment mechanism for an optical gun sight which includes windage and elevation screws which bear against an internal component of the sight that defines the line of sight of the sight. A spring biases the internal component against the windage and elevation screws. Hardened steel balls are set into the internal component and affixed thereto at approximate positions to provide point contact between the internal component and the windage and elevation screws, and between the internal component and the spring. Adjustment friction is thus reduced with a resultant reduction in tracking error.

2 Claims, 3 Drawing Figures

SIGHT WITH REDUCED FRICTION LINE OF SIGHT ADJUSTMENT

This is a continuation of application Ser. No. 736,661, filed Oct. 29, 1976, now abandoned.

This invention relates to a mechanism for providing more accurate adjustment of the line of sight of an optical gun sight. The accuracy is achieved by reducing the amount of friction present between the adjustment mechanism and the line of sight-defining internal component of the sight.

It is, of course, well known to provide a mechanism to adjust the line of sight of an optical gun sight, and thereby permit corrections for windage and elevation of the projectile path to be made. The optical sight includes some form of a reticle which defines an aiming point for the sight, and the correction adjustments may be made in a number of different ways, as, for example, by moving the reticle laterally within the sight housing with windage and elevation screws, or, by moving the erector lens set, or a part thereof, laterally within the sight housing, thereby shifting the target image.

The most common form of windage and elevation adjustments found in prior art optical sights utilizes windage and elevation screws which are mounted in internally threaded turrets, or nuts. The turrets are secured to the sight housing and the screws are accessible from the outside of the housing. An inner end of each screw bears against a reticle cell, or an erector lens cell. The cells are pivotally or laterally movably mounted in the sight housing, and a blade or other type of spring is mounted in the housing for engagement with the cell to bias the latter against the inner ends of the adjustment screws. As the inner ends of the screws, bearing against the cells, turn when the screws are adjusted in or out, friction is generated. This friction tends to try to pivot the cells in a direction perpendicular to the direction of axial movement of the screws which leads to errors in the positioning of the line of sight of the sight. The friction is increased when there is line contact between the inner end of the screws and the cell. Such is the case where the inner ends of the screws are flat and the cell is cylindrical. The friction, on the other hand, is minimized or eliminated if there is point contact between the inner ends of the screws and the cell.

In addition to the above-noted considerations, modern day gun sights are preferably made as light weight as possible, for obvious reasons. In order to lighten sight weight, as many as possible of the internal components, which are not subjected to the abuse that the housing is, are preferably made from a light weight metal, such as aluminum. Such is the case with the internal cells, be they reticle cells or erector lens cells. On the other hand, the adjustment screws and turrets are best formed from hardened steel since they are subject to fine machining and wear during use of the sight. For best performance, the springs used in the adjustment mechanisms are also formed from steel. Thus, one assembly, the sight will have parts made of different hardness materials, i.e. aluminum and steel, in stressed engagement with each other. For example, an aluminum erector lens tube, or reticle holder, will be engaged by a steel spring, and by steel windage and elevation adjustment screws. Because of the spring, this engagement will be stressed. In view of the fact that aluminum is a relatively soft metal, and steel is a relatively hard metal, undesirable generation of friction discussed above will be present when the adjustment screws are manipulated, and, additionally, the steel will tend to gouge or scratch the aluminum with repeated usage. Both of these conditions will lead to tracking errors in positioning the aiming point of the sight.

This invention relates to the reduction of friction and wear generated between an internal tubular body which may be made of aluminum or other appropriate material, which is pivoted to adjust the aiming point of the sight, and the steel adjustment screws which are manipulated from the outside of the sight. This invention can also be utilized to reduce friction and wear between the internal aluminum tubular body and the steel spring which engages and biases the former within the sight housing. Wear and friction reduction is accomplished in accordance with this invention by embedding and securing small steel balls in the outside surface of the aluminum tube at points of contact with the adjustment screws and preferably also with the spring or springs. The embedded steel balls provide two advantages over the prior art, first, they reduce or eliminate friction and wear at the point of contact, and, secondly, they provide for point contact with the flat ends of the adjustment screws and springs. Both advantages contribute to more accurate and repeatable positioning of the aiming point of the sight.

It is, therefore, an object of this invention to provide an optical sight construction which displays improved adjustability of the aiming point of the sight.

It is a further object of the invention to provide a sight of the character described wherein the amount of friction and wear produced at the point of contact between the adjustment screws and the erector lens tube is substantially reduced.

It is an additional object of this invention to provide a sight of the character described wherein the erector lens tube is made of aluminum, the adjustment screws are made of steel, and there are steel balls embedded in and secured to the outside surface of the erector lens tube at points of contact between the latter and the adjustment screws.

It is a further object of this invention to provide a sight of the character described wherein point contact between the ends of the adjustment screws and the erector tube is established.

These and other objects and advantages of the invention will become more readily apparent from the following detailed description of a preferred embodiment of the invention taken in conjunction with the accompanying drawings, in which.

Figure 1:
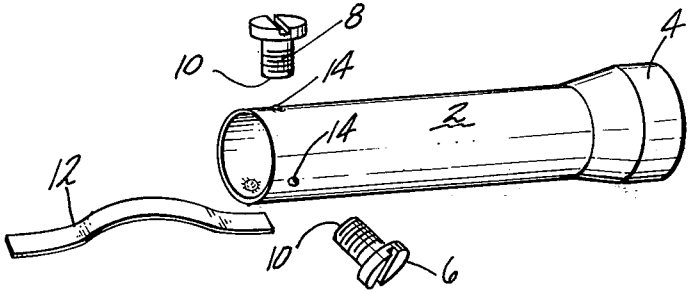
FIG. 1 is an exploded perspective view of a portion of a sight formed in accordance with this invention.

Referring now to FIG. 1 there is shown a portion of the internal structure of an optical gun sight. The portion shown includes a tubular housing 2 which houses the erector lenses of the sight. The housing 2 is flared at its rearward end 4 to provide means whereby the housing 2 can be pivoted about its rear end within the sight barrel. In the embodiment shown, the housing 2 contains the entire erector lens set and is pivoted about its rearward end, however, it will be understood that only a portion of the erector lens set could be contained within the housing and/or the housing could be pivoted about its forward end without departing from the spirit of the invention. The erector lens housing 2 is made of aluminum which, of course, is light weight and relatively soft. Also shown in FIG. 1 are windage and elevation adjustment screws 6 and 8 respectively. These screws are threadedly mounted in internally threaded nuts (not shown) which are secured to the sight barrel in a conventional manner. The adjustment screws 6 and 8 are formed with an inner flat end 10 which bears against the erector lens housing 2 in a manner to be described hereinafter. A blade spring 12 is disposed inside of the sight barrel for engagement with the erector lens housing 2 to bias the latter against the adjustment screws in a conventional manner. Steel balls 14 are embedded in the aluminum erector lens housing in the areas thereof which align with the flat ends 10 of the adjustment screws, and also in any areas thereof contacted by the adjustment spring 12.

Figure 2:
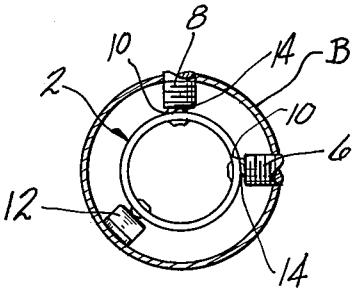
FIG. 2 is an axial sectional view of a sight showing the manner in which the balls engage the adjustment screws and spring.

Referring to FIG. 2, the sight barrel B is shown for reference purposes. It will be noted that the embedded steel balls 14 protrude above the outer curved surface of the erector lens housing 2 far enough so that the flat end surfaces 10 of the adjustment screws 6 and 8 cannot contact the outer surface of the erector lens housing 2 at any pivot angle that the housing 2 can assume within the barrel B during adjustment of the line of sight of the instrument. The same condition holds for the spring 12, e.g. it cannot contact the outside surface of the erector lens housing 2 during adjustment of the line of sight.

Figure 3:
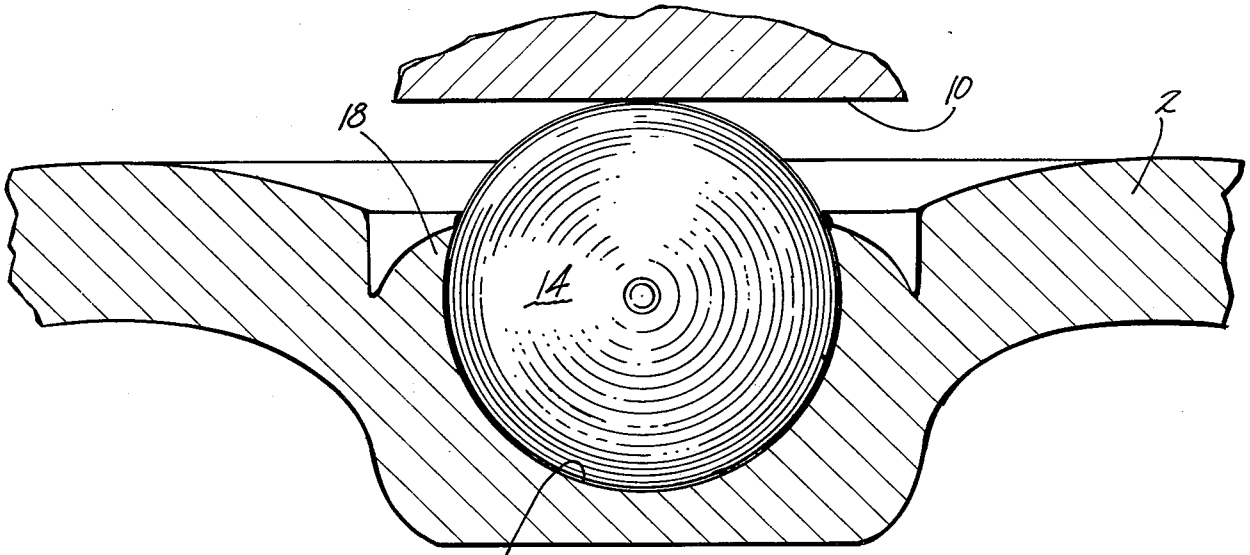
FIG. 3 is an enlarged sectional view of the area of the erector lens tube wherein one of the balls is set showing the manner of embedment and contact between the ball and the end of an adjustment screw.

Referring now to FIG. 3, the manner in which the balls 14 are embedded in the housing 2 is shown in detail. It will be noted that there is a socket 16 formed in the outer surface of the housing 2, in which socket 16 the ball 14 is seated. The ball 14 must be immovably secured within the socket 16. This is preferably done by forming tangs 18 in the housing material which tangs grip and hold the ball 14 firmly in place. In place of the integral tangs 18, it is possible to use some other securement means, such as adhesive, a metallurgical joint, or a deformable washer or the like without departing from the spirit of the invention. The socket 16 may be formed in a number of ways, as for example, by a separate punch, a cutter, or the like, however, preferably, the socket 16 is formed by the ball 14 as the latter is pressed into the outside surface of the housing 2. The tangs 18 are then rolled partially over the ball 14 to hold the latter in place. However, the ball 14 is set into the socket 16, it is critical to improved performance that the ball 14 be immovable within the socket while, at the same time, being fastened to the housing 2. From FIG. 3 it is apparent that there is point contact established between the bottom surface 10 of the adjustment screw and the ball 14. The same is true for the spring and the ball.

It is readily apparent that the use of polished precision steel balls of high hardness embedded in and secured to the outer surface of an aluminum erector lens housing in the area thereof normally contacted by the adjustment screws and by the adjustment spring will reduce wear and friction by providing point contact between two hard steel surfaces. The steel balls are sufficiently small so as to add no appreciable weight to the aluminum erector lens housing. The sight can be factory disassembled without fear of losing the balls which are secured to the housing. Improved product life and aiming accuracy are achieved at little or no added cost.

Since many changes and variations of the disclosed embodiment of the invention may be made without departing from the inventive concept, it is not intended to limit the invention otherwise than as required by the appended claims.

What is claimed is:

1. In an optical gunsight of the type comprising a barrel; windage and elevation adjustment screws made of a relatively hard material and threadedly mounted on said barrel, said adjustment screws having inner ends disposed in the interior of said barrel; an erector lens housing disposed for pivotal movement within said barrel, said erector lens housing being biased by spring means disposed within said barrel, the improvement comprising: a plurality of spheres tightly embedded in said erector lens housing at locations wherein said spheres provide point contact with the inner ends of said adjustment screws and with said spring means, said spheres being made of a material which is at least as hard as the material from which said adjustment screws are made to minimize wear and increase accuracy and repeatability of the line of sight adjustment of the gunsight.

2. In an optical gunsight of the type comprising a barrel; windage and elevation adjustment screws made of a relatively hard metal and threadedly mounted on said barrel, said adjustment screws having inner ends disposed in the interior of said barrel; an erector lens housing disposed for pivotal movement within said barrel, said erector lens housing being biased by spring means disposed within said barrel, the improvement comprising: contact means mounted on said erector lens housing for providing point contact with the inner ends of said adjustment screws and with said spring means, said contact means being made of a material which is at least as hard as the metal from which said adjustment screws are made to minimize wear and increase accuracy and repeatability of the line of sight adjustment of the gunsight.

* * * * *